US005478256A

United States Patent [19]

Koganemaru et al.

[11] Patent Number: 5,478,256

[45] Date of Patent: Dec. 26, 1995

[54] FIRE DETECTOR HAVING BAYONET COUPLING AND LOCKING MECHANISM FOR BASE AND DETECTOR UNIT

[75] Inventors: Kazuyuki Koganemaru; Yasuo Ariga, both of Tokyo, Japan

[73] Assignee: Nohmi Bosai Ltd., Tokyo, Japan

[21] Appl. No.: 341,968

[22] Filed: Nov. 16, 1994

Related U.S. Application Data

[62] Division of Ser. No. 49,868, Apr. 23, 1993, Pat. No. 5,403, 198.

[30] Foreign Application Priority Data

Apr. 25, 1992 [JP] Japan ..... 4-131540

[51] Int. Cl.[6] ..... H01R 13/625; H01R 31/08

[52] U.S. Cl. ..... 439/507; 439/333; 439/952

[58] Field of Search ..... 439/507, 508, 439/509, 510, 511, 512, 513, 514, 515

[56] References Cited

U.S. PATENT DOCUMENTS

| | | | |
|---|---|---|---|
| 1,774,461 | 8/1930 | Van Amburg | 439/333 |
| 3,292,135 | 12/1966 | Robinson | 439/333 |
| 3,767,917 | 10/1973 | Lampart et al. | 250/83.6 FT |
| 3,905,667 | 9/1975 | Crimmins et al. | 439/511 |
| 4,139,770 | 2/1979 | Beyersdorf | 250/381 |
| 4,396,840 | 8/1983 | Araki et al. | 250/381 |
| 4,584,485 | 4/1986 | Powers et al. | 250/574 |
| 4,672,217 | 6/1987 | Dobrzanski | 250/574 |
| 4,786,811 | 11/1988 | Sasaki | 250/385.1 |
| 4,897,634 | 1/1990 | Sawa et al. | 250/574 |

FOREIGN PATENT DOCUMENTS

| | | |
|---|---|---|
| 2539655 | 2/1977 | Germany . |
| 643383 | 5/1984 | Switzerland . |

*Primary Examiner*—Neil Abrams
*Attorney, Agent, or Firm*—Wenderoth, Lind & Ponack

[57] ABSTRACT

A fire detector includes both a detector unit and a detector base including a base block to which the detector unit is mounted. The detector unit has an outermost peripheral wall, an engaging portion located inwardly of the outermost peripheral wall, and connecting members of a bayonet coupling. The detector base includes coupling members of a bayonet coupling engaged with the coupling members of the detector unit. The bayonet coupling is locked in place by a locking spring of the base block of the detector base, which locking spring engages the engaging portion of the detector unit. A pair of spaced apart connecting terminals for connection with a power and signal line are fixed on the base block. These terminals have small holes, respectively. A jumper spring having a main portion and bent ends is connected to the terminals by inserting the bent portions of the spring into the small holes, to thereby produce a short-circuit which allows the detector base to be inspected prior to the mounting of a detector unit to the base block. The jumper spring may be readily pulled from the terminals even once the base block has been mounted to the ceiling.

4 Claims, 8 Drawing Sheets

FIRE DETECTOR HAVING BAYONET COUPLING AND LOCKING MECHANISM FOR BASE AND DETECTOR UNIT

This is a Divisional application of Ser. No. 08/049,868, filed Apr. 23, 1993 and now U.S. Pat. No. 5,403,198.

BACKGROUND OF THE INVENTION

1. Field of the Invention

The present invention relates to a detector base which is installed on a ceiling in advance and to which a detector unit is mounted.

2. Description of the Related Art

In order to prevent unauthorized removal of a detector unit of a fire detector from its base, the known detector unit and base are coupled together with a bayonet coupling, and a locking means maintains the coupled state. The locking means is designed as follows. A portion of the base block of the detector base is notched and a movable tongue is arranged in the notch in such a manner that it can be touched and swung while the fire detector unit is being mounted on the base. A recess formed at the bottom of the detector unit receives a locking projection provided on the movable tongue.

A portion of the base block of the detector base, which is thin from an aesthetic point of view, is notched and the movable tongue is arranged in the notch. It is difficult to sufficiently increase the range over which the movable tongue can be swung. Accordingly, the range over which the locking projection of the moving tongue can be swung is small, and the engagement between the locking projection of the moving tongue and the base block is accordingly weak. As a result, only a light touch on the movable tongue is sufficient to release the engagement and so, the detector unit can be easily removed from the base deliberately by mischief or the like.

Also, another type of known detector base sends information to a receiver or a transmitter when a fire detector unit is removed from its base. A pair of lines, each of which serves as both a power and a signal line and extends from a receiver or a transmitter, are connected to the detector base. When the fire detector unit is removed from the base deliberately by mischief or the like, one of the pair of lines is disconnected and thereby informs the receiver or the transmitter in the form of a disconnect signal that the first detector unit has been removed.

In this type of a detector base, one of the pair of lines is divided in half and its one end is connected to a first connecting terminal of the base while its other end is connected to a second connecting terminal of the base. When the fire detector unit is correctly mounted on the base, the first and second connecting terminals of the base are shorted by means of a jumper wire disposed within the fire detector unit. Hence, when the fire detector unit is removed from the base, the first and second connecting terminals are disconnected.

In such a detector base, it is necessary to mount the fire detector unit on the base and short the first and second connecting terminals in order to tell whether the base is correctly connected to the power and signal lines. However, if the fire detector unit is mounted on the base for that purpose, the fire detector unit might possibly be damaged during subsequent assembly work. Therefore, a jumper wire is screwed between the first and second connecting terminals. This is extremely time-consuming work in that it involves screwing a short-circuiting wire for the purpose of the inspection and unscrewing the wire after the inspection in order to mount the fire detector unit on the base.

SUMMARY OF THE INVENTION

In view of the foregoing problems in the related art, an object of the present invention is to provide a detector base which can prevent a mounted fire detector unit from being easily removed by mischief or the like.

Another object of the present invention is to provide a detector base in which it is easy to check whether the base is corrected connected to the power and signal lines even during the installation thereof on the ceiling of a room.

To achieve the above objects, according to a first aspect of the present invention, there is provided a detector base comprising a base block for supporting a detector unit, the base block including an opening which is located outside of the outermost peripheral wall of the detector unit when the detector unit is attached to the base block; a locking spring having one end secured to the base block and a free end, the spring being exposed via the opening; and engaging means provided for a movable portion of the locking spring and adapted to engage the detector unit.

Furthermore, according to a second aspect of the present invention, there is provided a detector base comprising a base block for supporting a detector unit; a pair of connecting terminals having the same polarity fixed on the base block as spaced apart from each other and the pair of connecting terminals having small holes, respectively; and short-circuiting means for electrically connecting the pair of connecting terminals when both ends of the short-circuiting means are inserted into the small holes formed in the pair of the connecting terminals, respectively.

DETAILED DESCRIPTION OF THE PREFERRED EMBODIMENTS

An embodiment of the present invention will be described with reference to the accompanying drawings.

Figure 1:
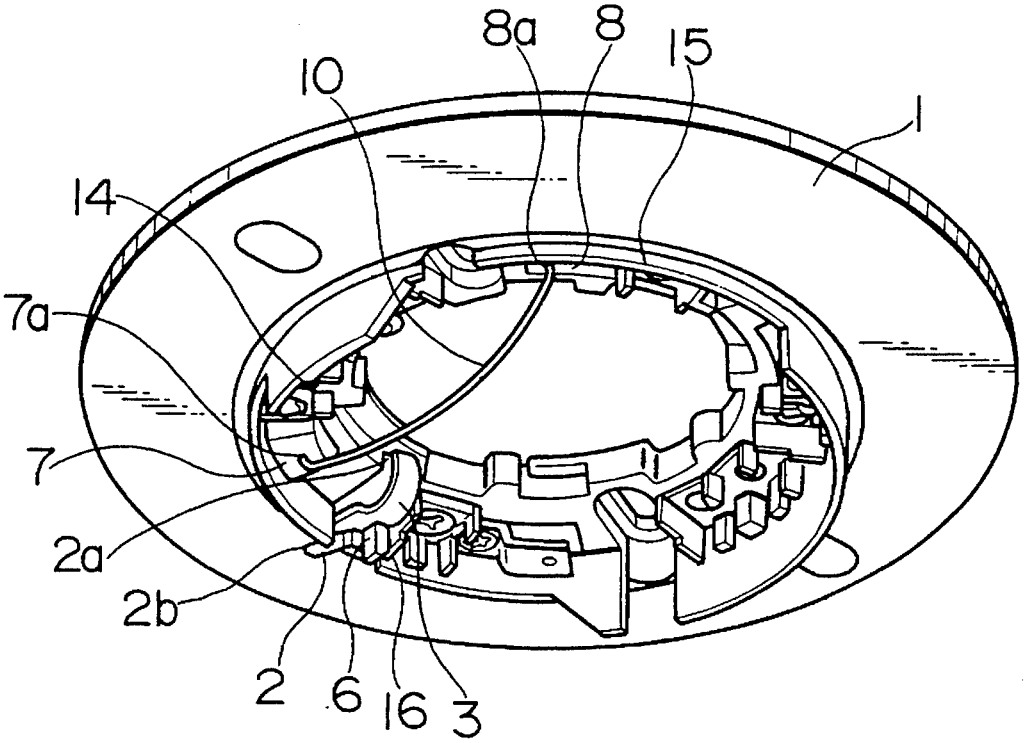
FIGS. 1–3 are a perspective view, a top view and a bottom view, respectively, of a detector base of an embodiment of a fire detector according to the present invention.
Figure 2:
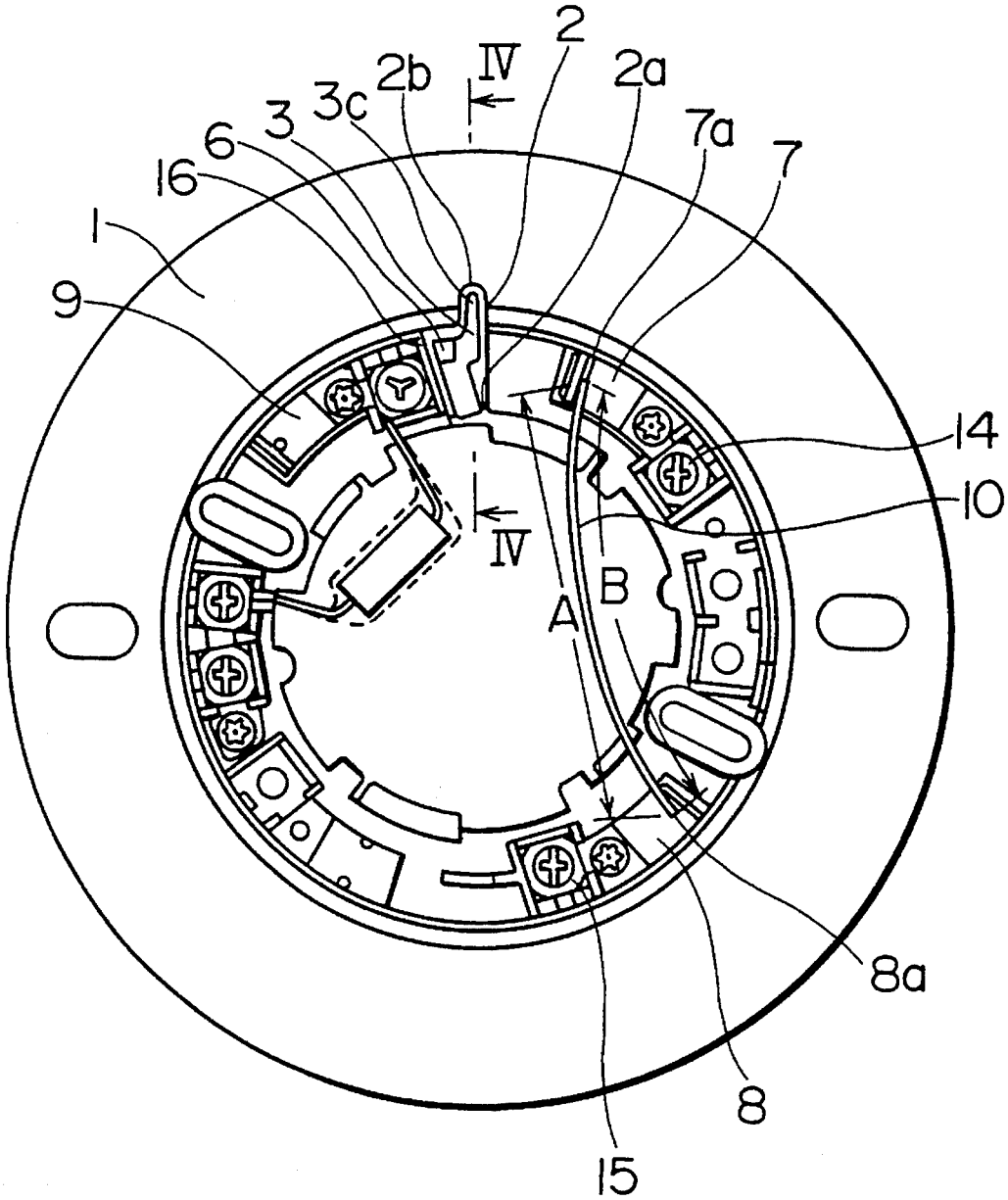
Figure 3:
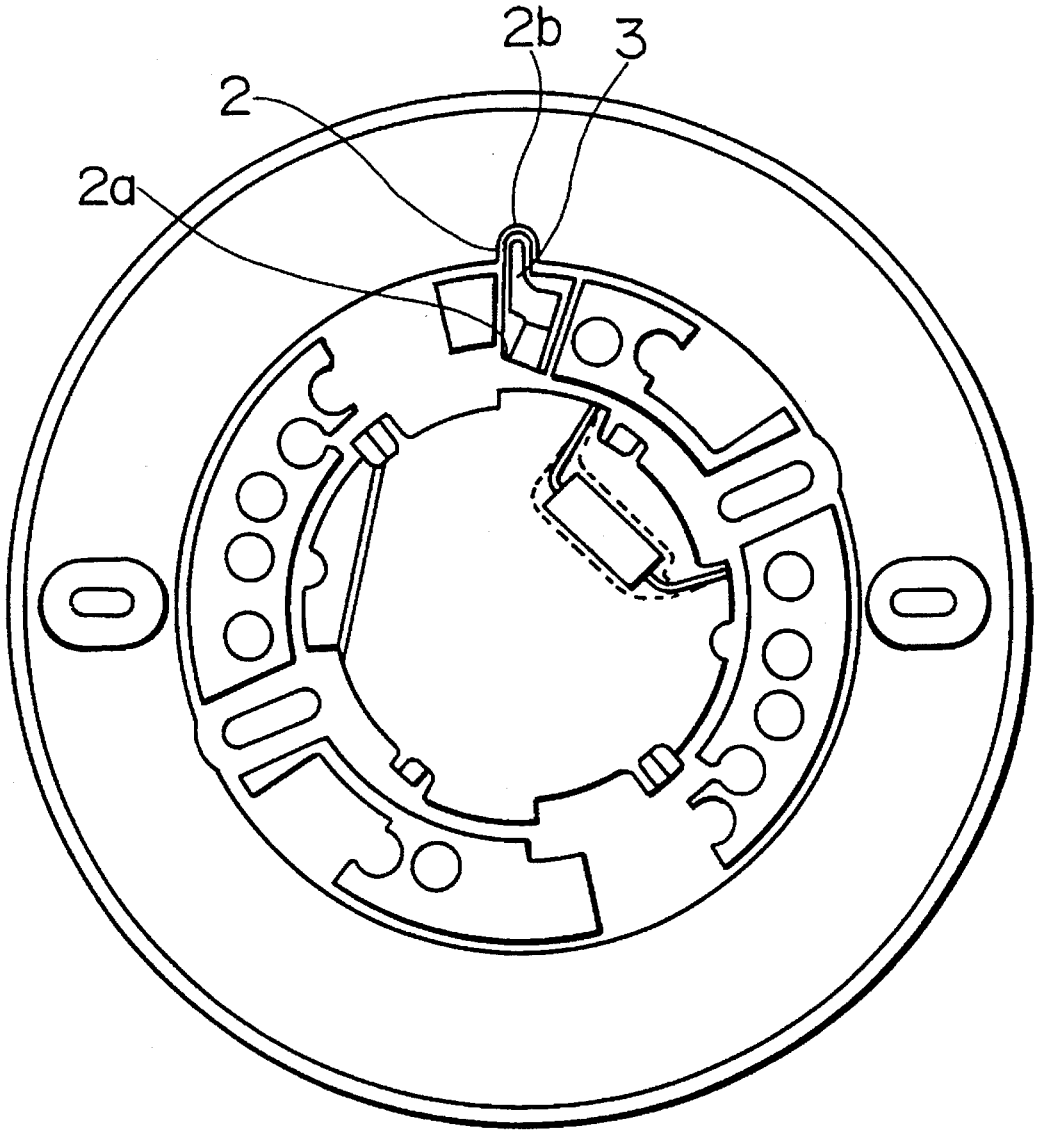
Figure 4:
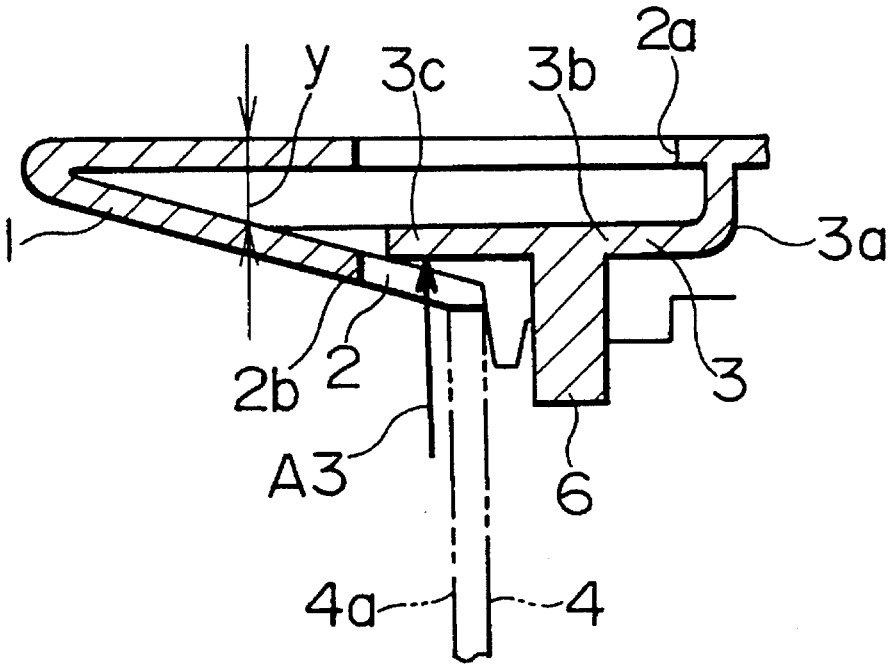
FIG. 4 is a sectional view taken along line IV—IV shown in FIG. 2.

As shown in FIGS. 1–3, an elongate hole 2 is provided radially in a circular base block 1. A spring 3 is integral with the base block 1 at the end 2*a* of the elongate hole 2 located closest to the center of the base block 1. As illustrated in FIG. 4, the spring 3 has a vertical piece 3*a* which is raised from the one end 2*a* of the elongate hole 2 and a horizontal piece 3b having one end connected to the vertical piece 3a and the other end which is a free end 3c. The horizontal piece 3b is provided substantially in parallel with the elongate hole 2. The free end 3c of the horizontal piece 3b and the other end 2b of the elongate hole 2 are arranged such that they are positioned at the outside of a peripheral portion 4a of a fire detector unit 4 when the fire detector unit 4 is attached to the base block 1. More specifically, the free end 3c of the spring 3 faces the outside from this detector base through a part of the elongate hole 2 when the fire detector is attached. A prismatic engaging portion protrudes downwards substantially from the middle part of the horizontal piece 3b.

Figure 5:
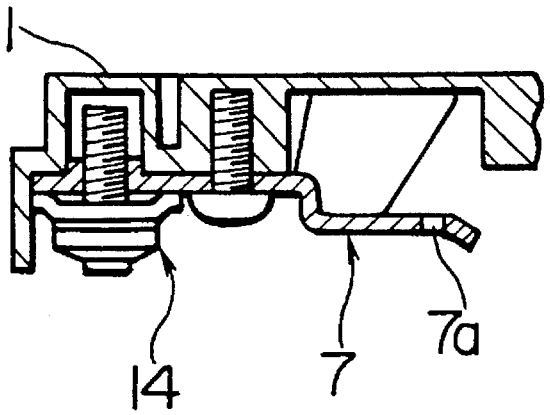
FIG. 5 is a sectional view of a principal portion of the embodiment.

Connecting terminals 7 and 8 having the same polarity are respectively fixed circumferentially on the base block 1 so as to be spaced apart from each other. As shown in FIG. 5, a small hole 7a is formed in the connecting terminal 7. Likewise, a small hole 8a is formed in the connecting terminal 8. Screws 14 and 15 are associated with these connecting terminals 7 and 8, respectively. One of a pair of lines which serve both as power and signal lines extending from a receiver or a transmitter (not shown) is divided in half and one end thereof is connected to the connecting terminal 7 by the screw 14 while the other end thereof is connected to the connecting terminal 8 by the screw 15.

Figure 6:
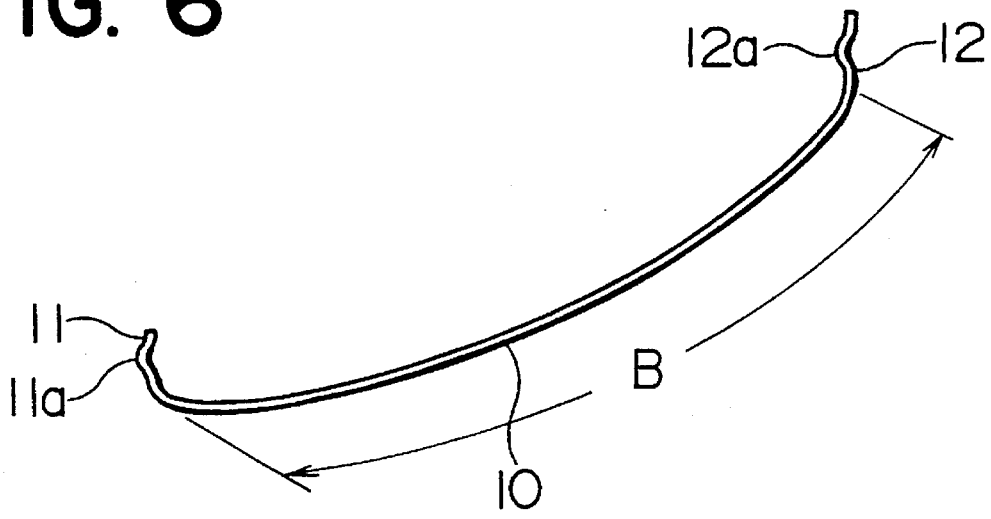
FIG. 6 is a perspective view of a curved spring for a jumper wire used in the embodiment.

As illustrated in FIG. 6, a curved spring 10 of a jumper wire has a main portion of the length B, and bent portions 11 and 12 at both ends of the main portion. Furthermore, snaps 11a and 12a are formed in the bent portions 11 and 12. The bent portions 11 and 12 are firmly received in the small holes 7a and 8a of the connecting terminals 7 and 8 when the former are inserted into the latter. As shown in FIG. 2, the length B of the main portion of the spring 10 is adapted to be slightly longer than the straight distance A between the small hole 7a of the connecting terminal 7 and the small hole 8a of the connecting terminal 8. Thus, when the bent portions 11 and 12 are inserted into the small holes 7a and 8a, respectively, the curved spring 10 of the jump wire bends somewhat.

As shown in FIG. 2, another connecting terminal 9 is also arranged on the base block 1 in such a manner that it is spaced apart from connecting terminals 7 and 8.

Figure 7:
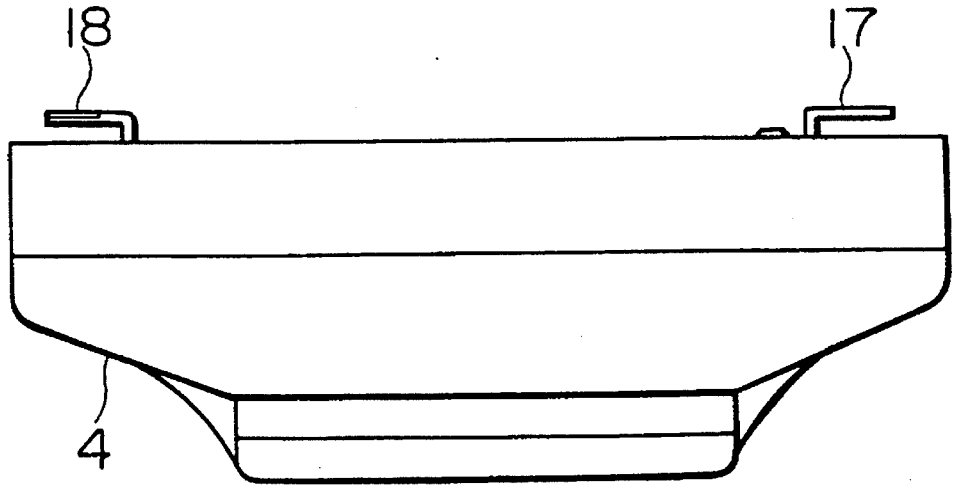
FIGS. 7 and 8 are a front view and a plan view, respectively, of a fire detector unit which is to be mounted on a base of the embodiment.
Figure 8:
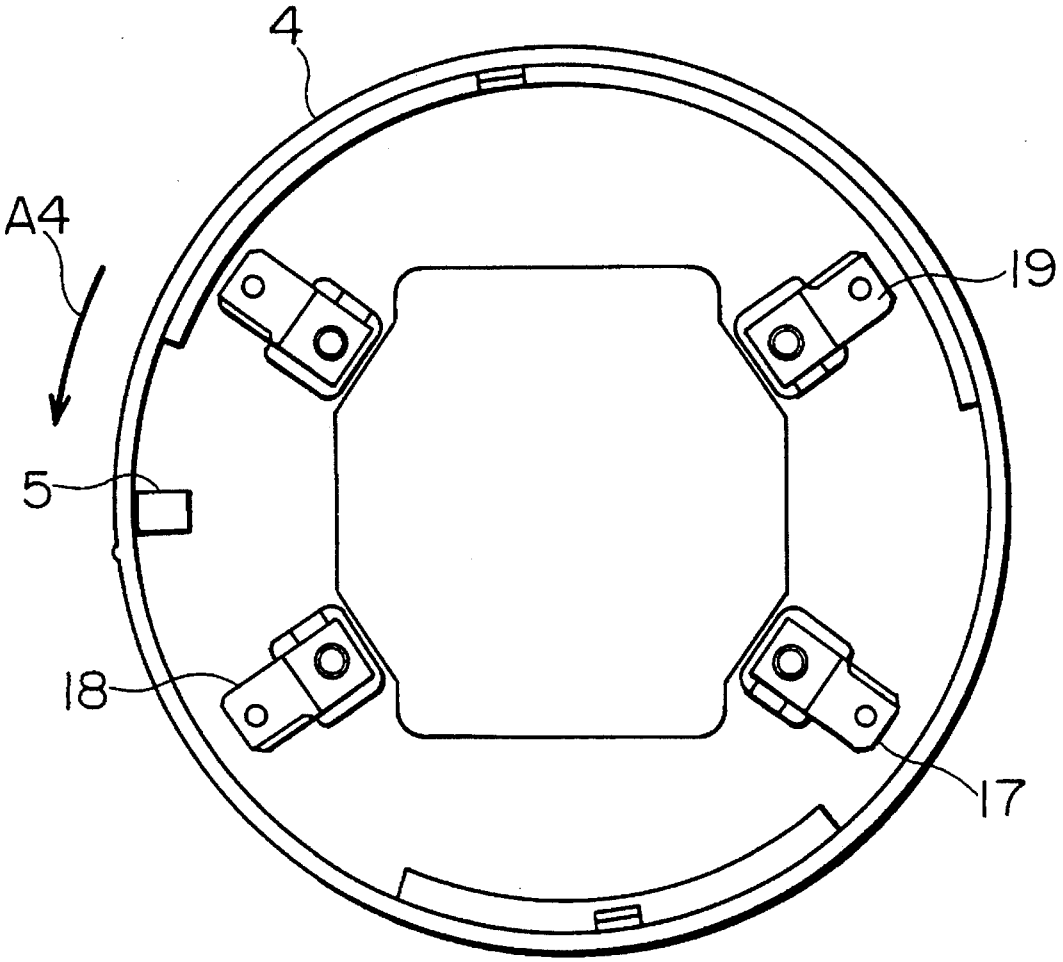
Figure 10:
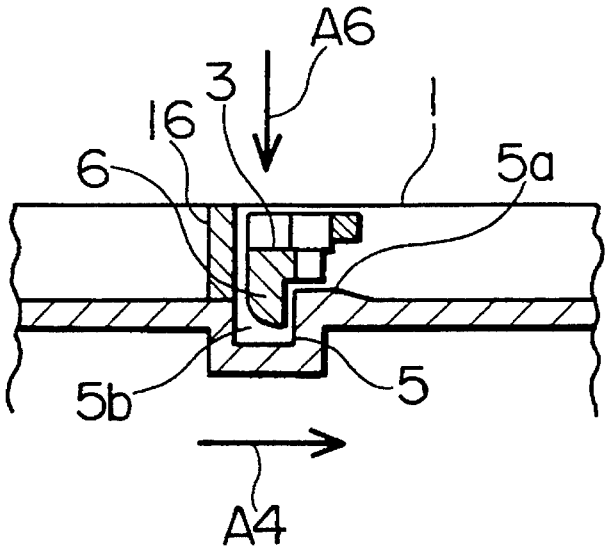
FIG. 10 is a sectional view taken along line X—X shown in FIG. 9.

The procedure to be followed when a fire detector unit is mounted on the detector base will now be described. First, a fire detector unit 4 to be mounted on the base is shown in FIGS. 7 and 8. The fire detector unit 4 includes connecting terminals 17, 18 and 19 which are, respectively, bayonet-fitted to the connecting terminals 7, 8 and 9 of the detector base. Also, in the fire detector unit 4, an engaging portion 5 is formed at a portion corresponding to the engaging portion 6 of the spring 3. As illustrated in FIG. 10, the engaging portion 5 defines a recess 5b into which the engaging portion 6 of the spring 3 on the base is inserted and a projection 5a formed at the edge of the recess 5b.

Figure 9:
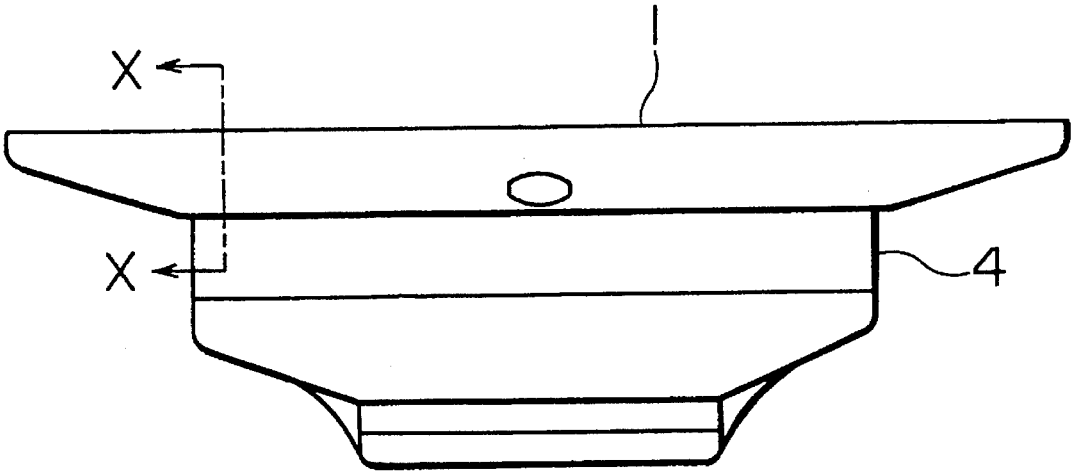
FIG. 9 is a front view of the fire detector.

It will be assumed that a detector base shown in FIG. 1 is fixed on the ceiling of a room in advance. The fire detector unit 4 is placed over the base block 1, and in that condition the fire detector unit 4 is rotated at a predetermined angle counterclockwise as indicated by arrow A4 in FIG. 8, thereby bayonet-fitting the connecting terminals 7, 8 and 9 of the base to the connecting terminals 17, 18 and 19 of the fire detector unit 4. Thus, the fire detector unit 4 is mounted on the base as illustrated in FIG. 9.

As shown in FIG. 10, when the fire detector unit 4 is mounted on the base, the engaging portion 6 of the spring 3 passes over the projection 5a of the fire detector unit 4 and is received deeply within the recess 5b to be firmly engaged with the engaging portion 5, due to the elasticity of the spring 3 acting in a downwards direction as indicated by arrow A6, thereby locking the detector base to the fire detector unit.

On the other hand, as indicated in FIG. 4, when the fire detector unit 4 is removed from the base 1, pressure is applied upwardly to the free end 3c of the spring 3 as indicated by arrow A3, against the elasticity of the spring 3, by pushing a narrow bar or the like through the part of the elongate hole 2 which is exposed radially outwardly of the periphery of the fire detector unit 4. The spring 3 is deformed to such a degree that the free end 3c is displaced upwardly by a distance substantially the same as the height y of the vertical piece 3a. Hence, the engaging portion 6 formed on the spring 3 and the engaging portion 5 of the fire detector unit 4 are completely disengaged to release the fire detector 4. In this condition, the fire detector unit 4 is rotated at a predetermined angle in the opposite direction of arrow A4 in FIG. 10 in the horizontal plane, thereby releasing the bayonet-fitting between the connecting terminals 7, 8 and 9 of the base and the connecting terminals 17, 18 and 19 of the fire detector unit 4.

A stopper 16 is formed near the spring 3 to prevent an excessive turning of the fire detector which could damage the spring 3.

Whether the detector base is correctly connected to the pair of lines (each of which serves both as a power and a signal line and extends from the receiver or the transmitter) can be determined during the installation work by the following method. Because the bent portions 11 and 12 of the curved spring 10 are fitted into the small holes 7a and 8a of the connecting terminals 7 and 8 of the base, respectively, the spring 10 provides an electrical short between the connecting terminals 7 and 8. The curved spring 10 is held securely due to its elasticity and cannot be released easily by vibrations or the like. Hence, an inspection can be performed without mounting the fire detector unit 4 on the base. Moreover, troublesome work, such as connecting a line between these connecting terminals 7 and 8 by utilizing the screws 14 and 15, is not necessary.

After the inspection, an inspector fastens a hook, which he carried with him in advance, on the spring 10 and pulls it downwards, thereby removing the spring 10 from the base. Afterwards, the detector unit 4 is mounted on the base as described above.

While preferred embodiments of the present invention have been described with reference to the accompanying drawings, it is to be understood that the invention is not limited to the preferred embodiments shown in the drawings. Partial modifications of the structure and additions thereto can also be made without departing from the scope of the invention.

Figure 11:
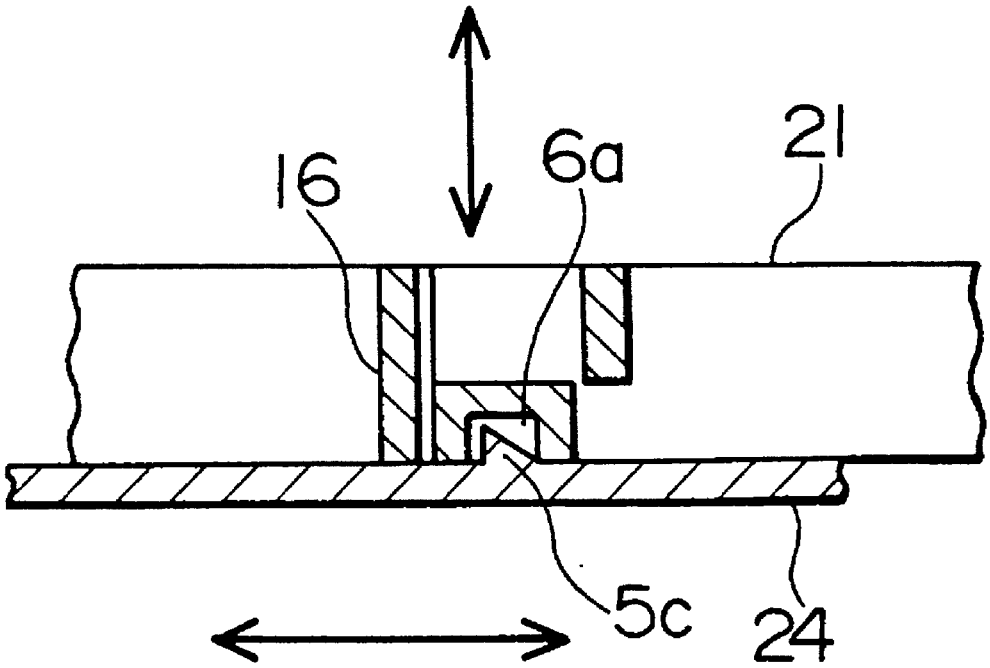
FIG. 11 is a sectional view of a principal portion of another embodiment of the fire detector showing the detector unit attached to the base.

For example, as illustrated in FIG. 11, the engaging portion of the base 21 may be in the form of a recess 6a in the horizontal piece 3b of the spring 3 and the engaging portion of the detector unit 24 may be in the form of a projection 5c which is inserted into the recess 6a.

What is claimed is:

1. A detector base comprising:

a base block for supporting a detector unit;

a pair of connecting terminals having the same polarity fixed on said base block as spaced apart from each other, said pair of connecting terminals having small holes, respectively; and short-circuiting means for electrically connecting said connecting terminals, said short-circuiting means comprising a curved spring having a main portion and bent portions at opposite ends of said main portion, respectively, said bent portions extending into said small holes of said connecting terminals, respectively, in such a manner that they can be detached from said connecting terminals.

2. A detector base according to claim 1, wherein the bent portions of said curved spring include snaps, said snaps being configured to provide for firm engagement with said connecting terminals while said snaps are received in the small holes of said connecting terminals.

3. A detector base according to claim 1, wherein said main portion of said curved spring is longer than a straight line extending between said connecting terminals.

4. A detector base according to claim 1, and further comprising setscrews for connecting a line used as a power and signal line to said pair of connecting terminals.

* * * * *